US005513397A

United States Patent [19]

Terry

[11] Patent Number: 5,513,397

[45] Date of Patent: May 7, 1996

[54] TOILET SEAT LIGHT

[76] Inventor: Jonathan E. Terry, 2110 Alder Pl., Craig, Colo. 81625

[21] Appl. No.: 304,518

[22] Filed: Sep. 12, 1994

[51] Int. Cl.[6] ..... E03D 9/00

[52] U.S. Cl. ..... 4/661; 362/253; 362/802

[58] Field of Search ..... 4/661; 362/253, 362/802

[56] References Cited

U.S. PATENT DOCUMENTS

| | | | |
|---|---|---|---|
| 4,860,178 | 8/1989 | Picon | 4/661 X |
| 5,136,476 | 8/1992 | Horn | 4/661 X |
| 5,150,962 | 9/1992 | Rauschenberger | 4/661 X |

*Primary Examiner*—Robert M. Fetsuga

[57] ABSTRACT

A new and improved toilet seat light comprised of a cylindrical container having a small shelf secured therein. The small shelf having an electrical contact plate thereon. A U-shaped on/off switch is secured within the cylindrical container parallel the small shelf. The on/off switch has an electrical contact plate thereon. A spring is secured to the U-shaped on/off switch and to the small shelf of the upper chamber of the cylindrical container. A small light bulb is secured within the cylindrical container. An upper wire couples the light bulb with the electrical contact plate of the U-shaped on/off switch. A power source is secured within the cylindrical container. A lid is removably secured to the cylindrical container. The lid serves to provide access to the power source therein. A lower wire couples the electrical contact plate of the small shelf to the power source. A securement bracket is secured to the cylindrical container.

3 Claims, 3 Drawing Sheets

10

TOILET SEAT LIGHT

BACKGROUND OF THE INVENTION

1. Field of the Invention

The present invention relates to a toilet seat light and more particularly pertains to illuminating a toilet area to indicate that a seat for the toilet is down with a toilet seat light.

2. Description of the Prior Art

The use of toilet lights is known in the prior art. More specifically, toilet lights heretofore devised and utilized for the purpose of lighting the toilet bowl are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,860,178 to Picon discloses a toilet bowl light.

U.S. Pat. No. 5,036,443 to Humble et al. discloses a proximity light.

U.S. Pat. No. 5,263,209 to Pattee discloses a night light for a toilet.

U.S. Pat. No. 5,136,476 to Horn discloses a toilet bowl illuminator.

U.S. Pat. No. 5,150,962 to Rauschenberger discloses a toilet bowl illuminating device.

While these devices fulfill their respective, particular objective and requirements, the aforementioned patents do not describe a toilet seat light for illuminating a toilet area to indicate that a seat for the toilet is down.

In this respect, the toilet seat light according to the present invention substantially departs from the conventional concepts and designs of the prior art, and in doing so provides an apparatus primarily developed for the purpose of illuminating a toilet area to indicate that a seat for the toilet is down.

Therefore, it can be appreciated that there exists a continuing need for new and improved toilet seat light which can be used for illuminating a toilet area to indicate that a seat for the toilet is down. In this regard, the present invention substantially fulfills this need.

SUMMARY OF THE INVENTION

In the view of the foregoing disadvantages inherent in the known types of toilet lights now present in the prior art, the present invention provides an improved toilet seat light. As such, the general purpose of the present invention, which will be described subsequently in greater detail, is to provide a new and improved toilet seat light and method which has all the advantages of the prior art and none of the disadvantages.

To attain this, the present invention essentially comprises a cylindrical container having an inner surface, an outer surface, an upper end, an open lower end, and an intermediate extent therebetween. The inner surface has an upper chamber and a lower chamber. A containment wall is secured within the inner surface. The containment wall serves to separate the upper chamber from the lower chamber. A small shelf is secured within the upper chamber. The small shelf has an electrical contact plate thereon. The device contains a U-shaped on/off switch having a first portion, a second portion, and an intermediate portion therebetween. The first portion is secured within the upper chamber of the cylindrical container parallel the small shelf. The intermediate portion is slidably received through the upper end of the cylindrical container. The first portion has an electrical contact plate thereon. The device contains a spring having a first end and a second end. The first end is secured to the first portion of the U-shaped on/off switch. The second end is secured to the small shelf of the upper chamber of the cylindrical container. The device contains a small light bulb having an upper end and a lower end. The lower end is secured within the upper end of the cylindrical container. The device contains an upper wire having a first end and a second end. The first end is coupled with the lower end of the light bulb. The second end is coupled with the electrical contact plate of the first portion of the U-shaped on/off switch. The device contains one AA battery secured within the lower chamber of the cylindrical container. A lid is removably secured to the open lower end of the cylindrical container. The lid serves to provide access to the lower chamber to replace the one AA battery therein. The device contains a lower wire having a first end and second end. The first end is coupled to the electrical contact plate of the small shelf. The second end is coupled to the AA battery. Lastly, the device contains a securement bracket having a first portion and a second portion. The first portion is secured to the outer surface of the cylindrical container downward of the upper end. The second portion extends outward from the first portion to secure the device to a lip of the toilet seat.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toilet seat light which has all the advantages of the prior art toilet lights and none of the disadvantages.

It is another object of the present invention to provide a new and improved toilet seat light which may be easily and efficiently manufactured and marketed.

It is a further object of the present invention to provide a new and improved toilet seat light which is of durable and reliable construction.

An even further object of the present invention is to provide a new and improved toilet seat light which is susceptible of a low cost of manufacture with regard to both materials and labor, and which accordingly is then susceptible of low prices of sale to the consuming public, thereby making such a toilet seat light economically available to the buying public.

Still yet another object of the present invention is to provide a new and improved toilet seat light which provides in the apparatuses and methods of the prior art some of the advantages thereof, while simultaneously overcoming some of the disadvantages normally associated therewith.

Even still another object of the present invention is to provide a new and improved toilet seat light for illuminating a toilet area to indicate that a seat for the toilet is down.

Lastly, it is an object of the present invention to provide a new and improved toilet seat light comprised of a cylindrical container having a small shelf secured therein. The small shelf having an electrical contact plate thereon. A U-shaped on/off switch is secured within the cylindrical container parallel the small shelf. The on/off switch has an electrical contact plate thereon. A spring is secured to the U-shaped on/off switch and to the small shelf of the upper chamber of the cylindrical container. A small light bulb is secured within the cylindrical container. An upper wire couples the light bulb with the electrical contact plate of the U-shaped on/off switch. A power means is secured within the cylindrical container. A lid is removably secured to the cylindrical container. The lid serves to provide access to the power means therein. A lower wire couples the electrical contact plate of the small shelf to the power means. A securement bracket is secured to the cylindrical container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
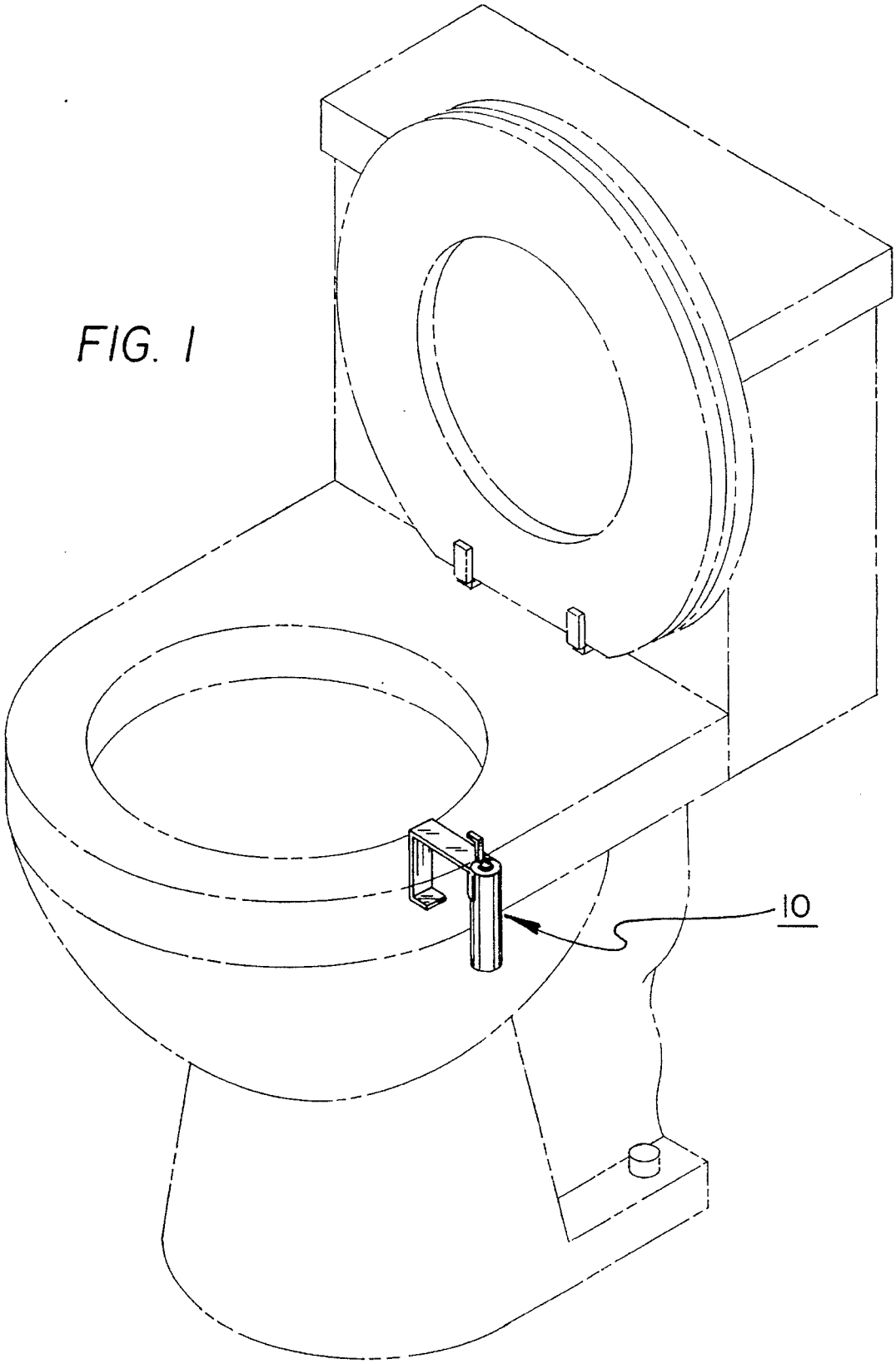
FIG. 1 is a perspective view of the preferred embodiment of the toilet seat light constructed in accordance with the principles of the present invention.
Figure 2:
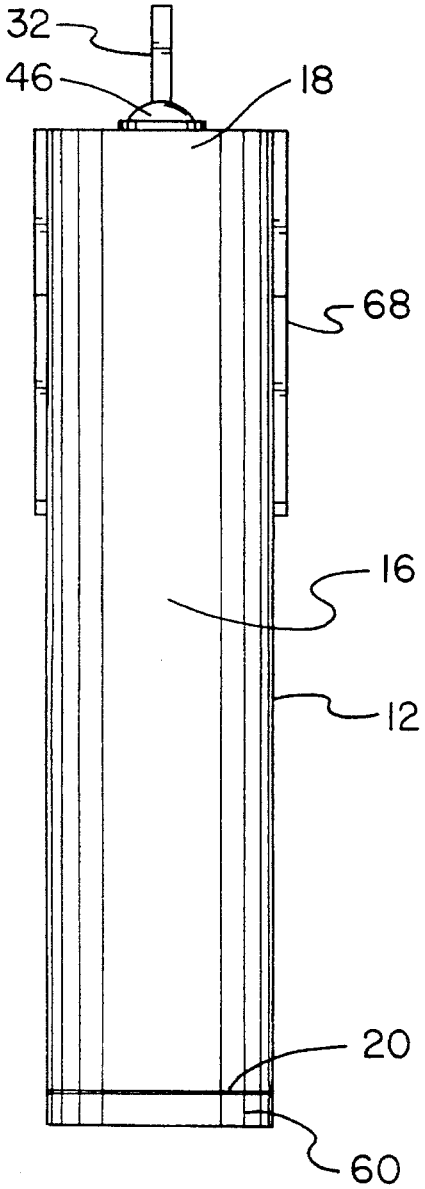
FIG. 2 is a side view of the preferred embodiment of the present invention.
Figure 3:
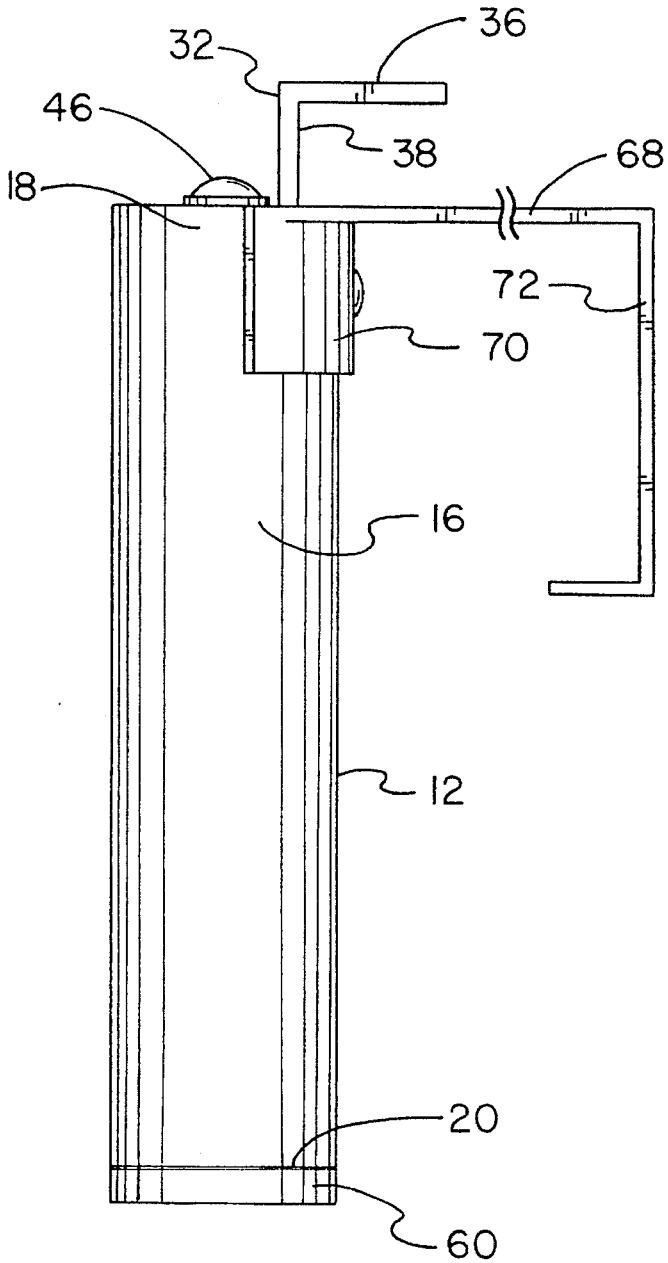
FIG. 3 is a rearward view of the preferred embodiment of the present invention.
Figure 4:
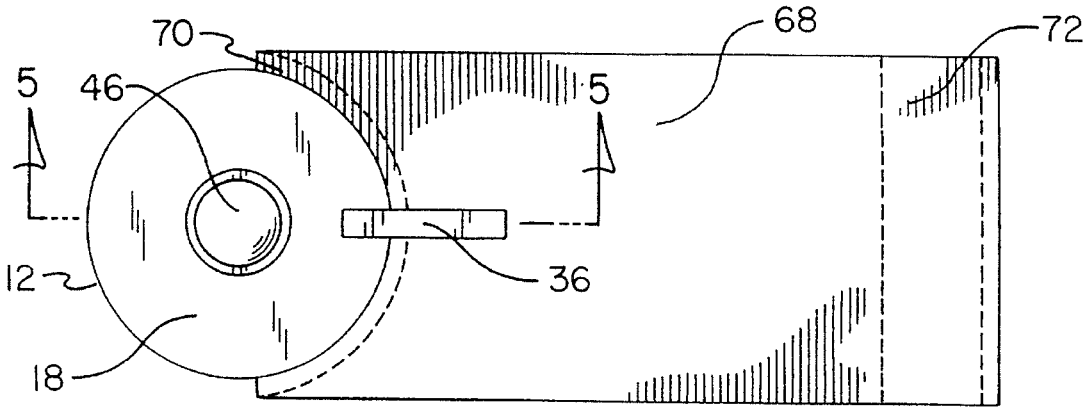
FIG. 4 is a plan view of the preferred embodiment of the present invention.
Figure 5:
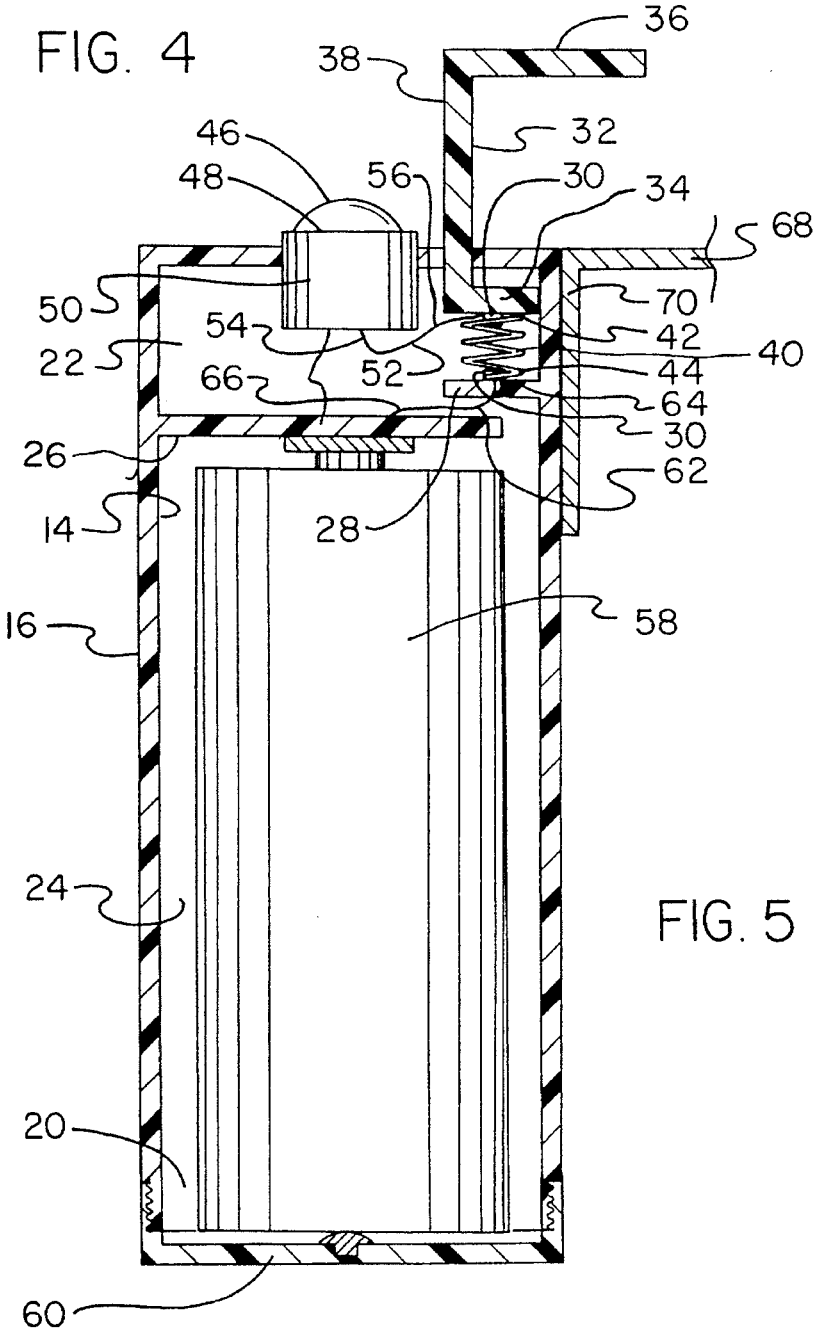
FIG. 5 is a cross-sectional view of the present invention taken along line 5—5 of FIG. 4.

With reference now to the drawings, and in particular, to FIG. 1 thereof, the preferred embodiment of the new and improved toilet seat light embodying the principles and concepts of the present invention and generally designated by the reference number 10 will be described.

Specifically, it will be noted in the various Figures that the device relates to a new and improved toilet seat light for illuminating a toilet area to indicate that a seat for the toilet is down.

The device 10 contains a cylindrical container 12 having an inner surface 14, an outer surface 16, an upper end 18, an open lower end 20, and an intermediate extent therebetween. The inner surface 14 has an upper chamber 22 and a lower chamber 24. A containment wall 26 is secured within the inner surface 14. The containment wall 26 serves to separate the upper chamber 22 from the lower chamber 24. A small shelf 28 is secured within the upper chamber 22. The small shelf 28 has an electrical contact plate 30 thereon.

The device 10 contains a U-shaped on/off switch 32 having a first portion 34, a second portion 36, and an intermediate portion 38 therebetween. The first portion 34 is secured within the upper chamber 22 of the cylindrical container 12 parallel to the small shelf 28. The intermediate portion 38 is slidably received through the upper end 18 of the cylindrical container 12. The first portion 34 has an electrical contact plate 30 thereon.

The device 10 contains a spring 40 having a first end 42 and a second end 44. The first end 42 is secured to the first portion 34 of the U-shaped on/off switch 32. The second end 44 is secured to the small shelf 28 of the upper chamber 22 of the cylindrical container 12.

The device 10 contains a small light bulb 46 having an upper end 48 and a lower end 50. The lower end 50 is secured within the upper end 18 of the cylindrical container 12. The small light bulb 46 is one that radiates a very dim light. The purpose of the light is to alert a person that the toilet seat is down. A dim light is used instead of a bright light so as not to awaken the person with the glare of a powerful light.

The device 10 contains an upper wire 52 having a first end 54 and a second end 56. The first end 54 is coupled with the lower end 50 of the light bulb 46. The second end 56 is coupled with the electrical contact plate 30 of the first portion 34 of the U-shaped on/off switch 32.

The device 10 contains one AA battery 58 secured within the lower chamber 24 of the cylindrical container 12.

A lid 60 is removably secured to the open lower end 20 of the cylindrical container 12. The lid 60 serves to provide access to the lower chamber 24 to replace the one AA battery 58 therein.

The device 10 contains a lower wire 62 having a first end 64 and second end 66. The first end 64 is coupled to the electrical contact plate 30 of the small shelf 28. The second end 66 is coupled to the AA battery 58.

The device 10 is activated when a user closes the bathroom seat. The seat falls on the second portion 36 of the U-shaped on/off switch 30 which will cause the intermediate portion 38 to slide downwards towards the small shelf 28. When the electrical contact plate 30 of the first portion 34 touches the electrical contact plate 30 of the small shelf 28, this connects the upper wire 52 with the lower wire 62. This causes the AA battery 58 to activate the small light bulb 46 and illuminate the toilet area.

Lastly, the device 10 contains a securement bracket 68 having a first portion 70 and a second portion 72. The first portion 70 is secured to the outer surface 16 of the cylindrical container 12 downward of the upper end 18. The second portion 72 extends outward from the first portion 70 to secure the device 10 to a lip of the toilet bowl. The securement bracket 68 can be made in varying sizes to correspond to varying sizes of toilet bowls.

The present invention is a small dim light that hooks onto a toilet to provide a signal at night that the seat is down. Useful to families with someone—often a woman—who is sometimes unpleasantly surprised by the toilet seat being up in the middle of the night.

The product consists of a small battery container with enough room for one AA battery, and a low-wattage bulb at the top of the container—much like a miniature flashlight. An on/off switch is located at the top of the battery container. The container is attached to a plastic bracket that reaches across the top edge of the toilet bowl and extends down and under the lip. The measurements of this bracket are roughly 1¾ inches for the part that goes across the top, and 1½ inches for the section that extends downward from the top to the bottom of the lip.

The container hangs vertically along the outside of the toilet bowl. The dim light alerts the user to the fact that the toilet seat is down. When in the down position, the seat applies pressure to the on/off switch, which turns on the light. When the seat is up, the circuit is broken and the light goes off.

The light on this product is dull enough not to completely awaken a sleepy person. It produces just enough light to be noticed. The horizontal section of the bracket could be made to be adjustable for toilets of different dimensions.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A toilet seat light for illuminating a toilet area to indicate that a seat for a toilet is down comprising, in combination:

a cylindrical container having an inner surface, an outer surface, an upper end, an open lower end, and an intermediate extent therebetween, the container further having an upper chamber and a lower chamber, a containment wall secured within the container, the containment wall serving to separate the upper chamber from the lower chamber, a small shelf secured within the upper chamber, the small shelf having an electrical contact plate thereon;

a U-shaped on/off switch having a first portion, a second portion, and an intermediate portion therebetween, the first portion positioned within the upper chamber of the cylindrical container parallel to the small shelf, the intermediate portion slidably received through the upper end of the cylindrical container, the first portion having an electrical contact plate thereon;

a spring having a first end and a second end, the first end secured to the first portion of the U-shaped on/off switch, the second end secured to the small shelf of the upper chamber of the cylindrical container;

a small light bulb having an upper end and a lower end, the lower end secured within the upper end of the cylindrical container;

an upper wire having a first end and a second end, the first end coupled with the lower end of the light bulb, the second end coupled with the electrical contact plate of the first portion of the U-shaped on/off switch;

one AA battery secured within the lower chamber of the cylindrical container and electrically connected to the light bulb;

a lid removably secured to the open lower end of the cylindrical container, the lid serving to provide access to the lower chamber to replace the one AA battery therein;

a lower wire having a first end and second end, the first end coupled to the electrical contact plate of the small shelf, the second end coupled to the AA battery;

a securement bracket having a first portion and a second portion, the first portion secured to the outer surface of the cylindrical container downward of the upper end, the second portion extending outward from the first portion to secure the device to a lip of a bowl of the toilet.

2. A toilet seat light for illuminating a toilet area to indicate that a seat for a toilet is down comprising, in combination:

a cylindrical container having a small shelf secured therein adjacent a top portion thereof, the small shelf having an electrical contact plate thereon;

a U-shaped on/off switch secured within the cylindrical container and having one leg thereof positioned parallel to the small shelf, the on/off switch having an electrical contact plate thereon;

a spring secured between the one leg of the U-shaped on/off switch and of the small shelf of the upper chamber;

a small light bulb secured to the top portion of the cylindrical container;

an upper wire coupling the light bulb with the electrical contact plate of the U-shaped on/off switch;

a power source secured within the cylindrical container and electrically connected to the light bulb;

a lid removably secured to the cylindrical container, the lid serving to provide access to the power source therein;

a lower wire coupling the electrical contact plate of the small shelf to the power source;

a securement bracket secured to the cylindrical container, the securement bracket adapted to secure the device to a lip of a toilet bowl of the toilet seat.

3. The device as described in claim 2 and further including wherein the power source is one AA battery.

* * * * *